US007431016B2

(12) United States Patent
Reinke

(10) Patent No.: US 7,431,016 B2
(45) Date of Patent: Oct. 7, 2008

(54) SYSTEM FOR CONTROLLING EVAPORATIVE EMISSIONS

(75) Inventor: Paul E. Reinke, Rochester Hills, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 11/668,888

(22) Filed: Jan. 30, 2007

(65) Prior Publication Data

US 2008/0183365 A1 Jul. 31, 2008

(51) Int. Cl.
*F02M 1/00* (2006.01)
*F02D 41/00* (2006.01)

(52) U.S. Cl. ..... 123/434; 123/673; 123/678

(58) Field of Classification Search ..... 123/434, 123/435, 436, 673, 677, 678, 689
See application file for complete search history.

(56) References Cited

U.S. PATENT DOCUMENTS 6,640,539 B1 * 11/2003 Lewis et al. ..... 60/284
6,666,021 B1 * 12/2003 Lewis et al. ..... 60/289
6,715,280 B2 * 4/2004 Lewis et al. ..... 60/274
7,185,487 B2 * 3/2007 Lewis et al. ..... 60/289
7,293,406 B2 * 11/2007 Lewis et al. ..... 60/284

* cited by examiner

*Primary Examiner*—John T Kwon

(57) ABSTRACT

A control system for controlling a valve in a fuel system of engine including an engine airflow sensor that senses a mass engine airflow ($M_{engair}$), a barometric pressure sensor that senses a barometric pressure ($P_{baro}$), and an ambient temperature sensor that senses an ambient temperature ($T_{amb}$). An actuator determination module determines an effective area ($A_{eff}$) of the valve based on at least one of the $M_{engair}$, the $P_{baro}$, and the $T_{amb}$. A duty cycle (DC) calculation module that determines a first duty cycle (DC) of the valve based on the $A_{eff}$.

9 Claims, 9 Drawing Sheets

SYSTEM FOR CONTROLLING EVAPORATIVE EMISSIONS

FIELD OF THE INVENTION

The present invention relates to internal combustion engines, and more particularly to a system for controlling engine emissions.

BACKGROUND OF THE INVENTION

Internal combustion engines combust an air/fuel (A/F) mixture within cylinders to drive pistons and to provide drive torque. Air is delivered to the cylinders via a throttle and an intake manifold. A fuel injection system supplies fuel from a fuel tank to provide fuel to the cylinders based on a desired A/F mixture. To prevent release of fuel vapor, a vehicle may include an evaporative emissions system which includes a canister that absorbs fuel vapor from the fuel tank, a canister vent valve, and a purge valve. The canister vent valve allows air to flow into the canister. The purge valve supplies a combination of air and vaporized fuel from the canister to the intake system.

Closed-loop control systems adjust inputs of a system based on feedback from outputs of the system. By monitoring the amount of oxygen in the exhaust, closed-loop fuel control systems manage fuel delivery to an engine. Based on an output of oxygen sensors, an engine control module adjusts the fuel delivery to match an ideal A/F ratio (14.7 to 1). By monitoring engine speed variation at idle, closed-loop speed control systems manage engine intake airflows and spark advance.

Typically, the fuel tank stores liquid fuel such as gasoline, diesel, methanol, or other fuels. The liquid fuel may evaporate into fuel vapor which increases pressure within the fuel tank. Evaporation of fuel is caused by energy transferred to the fuel tank via radiation, convection, and/or conduction. An evaporative emissions control (EVAP) system is designed to store and dispose of fuel vapor to prevent release. More specifically, the EVAP system returns the fuel vapor from the fuel tank to the engine for combustion therein.

The EVAP system includes an evaporative emissions canister (EEC) and a purge valve. When the fuel vapor increases within the fuel tank, the fuel vapor flows into the EEC. A purge valve controls the flow of the fuel vapor from the EEC to the intake manifold. The purge valve may be modulated between open and closed positions to adjust the flow of fuel vapor to the intake manifold. Improper operation of the purge valve may cause a variety of undesirable conditions including, but not limited to, idle surge, steady throttle surge, and undesirable emission levels.

SUMMARY OF THE INVENTION

A control system for controlling a valve in a fuel system of engine including an engine airflow sensor that senses a mass engine airflow ($M_{engair}$), a barometric pressure sensor that senses a barometric pressure ($P_{baro}$), and an ambient temperature sensor that senses an ambient temperature ($T_{amb}$). An actuator determination module determines an effective area ($A_{eff}$) of the valve based on at least one of the $M_{engair}$, the $P_{baro}$, and the $T_{amb}$. A duty cycle (DC) calculation module that determines a first duty cycle (DC) of the valve based on the $A_{eff}$.

In other features, the first DC is based on the $A_{eff}$, a first slope ($M_1$), a first offset ($B_1$), and a first DC equation, $$DC_{first} = \left(\frac{FP}{M_1}\right) * \frac{M_{engair}}{\left(C_1 * \delta * \frac{P_1}{(T_{amb})^{1/2}}\right)} - \frac{B_1}{M_1}.$$

The $A_{eff}$ is based on the $M_{engair}$, a purge flow percentage (FP) of the valve that is based on the $M_{engair}$, a first predetermined constant ($C_1$), a pressure driving function δ, a first pressure ($P_1$), the $T_{amb}$, and an $A_{eff}$ equation $$A_{eff} = FP * \frac{M_{engair}}{C_1 * \delta * P_1 * \left(\frac{1}{T_{amb}}\right)^{1/2}}.$$

The $P_1$ is based on the $P_{baro}$, a second predetermined constant ($K_1$), an active purge flow percentage ($FP_{act}$), the $M_{engair}$, the $T_{amb}$, the $P_{baro}$, and a $P_1$ equation, $$P_1 = P_{baro} - K * \left(FP_{act} * M_{engair} * \frac{T_{amb}}{P_{baro}}\right)^2.$$

In other features, the DC calculation module computes a compensated DC that is based on the $A_{eff}$, a second slope ($M_2$), a second offset ($B_2$), and a compensated DC equation $$DC_{first} = \left(\frac{FP}{M_2}\right) * \frac{M_{engair}}{\left(C_1 * \delta * \frac{P_1}{(T_{amb})^{1/2}}\right)} - \frac{B_2}{M_2}$$

when the first DC one of exceeds a DC threshold and falls below the DC threshold, the $M_2$ and the $B_2$ are based on the $B_1$, and the first DC is set equal to the compensated DC. The $B_1$ is based on at least one of: a manifold vacuum (MV), the V supplied to the valve, and the $T_{amb}$, wherein the MV is based on a MV equation ($P_{baro}-P_2$).

In other features, the DC calculation module commands the valve with a first delivered DC when a difference between the first DC and a second DC exceeds a predetermined comparison threshold, wherein the first delivered DC is based on the first DC and the second DC. The DC calculation module commands the valve with a second delivered DC when the difference between the first DC and the second DC falls below the predetermined comparison threshold, wherein the first delivered DC is set equal to the second delivered DC. The second DC is set equal to the first DC.

In other features, the δ is based on a pressure ratio of the $P_1$ to the $P_2$. The δ is equal to a δ constant when the pressure ratio falls below a δ threshold. δ is based on the $P_1$, the $P_2$, and a δ equation $\delta=3.8639(PR^{1.42857}-PR^{1.71428})^{0.5}$ when the pressure ratio exceeds a δ threshold.

A system for controlling fuel vapor in a fuel system of an engine includes an engine airflow sensor that senses mass engine airflow ($M_{engair}$). A purge initialization module determines an amount of the fuel vapor in the fuel system based on an active flow percentage ($FP_{act}$) and a desired flow percentage ($FP_{des}$), wherein the $FP_{act}$ and the $FP_{des}$ are based on the $M_{engair}$. A purge learn module controls the amount of the fuel vapor in the engine.

In other features, The purge initialization module increments the $FP_{act}$ when the $FP_{act}$ is below the $FP_{des}$. The purge initialization module calculates an adjusted second array value ($PLM_{adj}$) corresponding to the $M_{engair}$ based on an active second array value ($PLM_{act}$), an active first array value ($LTM_{act}$), the $FP_{des}$, the $FP_{act}$, and a $PLM_{adj}$ equation $$(PLM_{adj}) - (PLM_{act} - LTM_{act}) * \left(\frac{FP_{des}}{FP_{act}}\right) + LTM_{act}.$$

The $PLM_{adj}$, the $PLM_{act}$, and the $LTM_{act}$ are multipliers to a fuel rate. The $PLM_{adj}$, the $PLM_{act}$, the $LTM_{act}$, the $FP_{act}$, and the $FP_{des}$ are indexed by the $M_{engair}$.

In other features, the purge learn module calculates a limited flow percentage ($FP_{lim}$) for a predetermined second array threshold ($PLM_{lim}$) when the $PLM_{lim}$ exceeds the $PLM_{adj}$. The purge learn module calculates at least one second array value ($PLM_i$) based the $FP_{lim}$, a first array ($LTM_i$), the $LTM_{act}$, the $PLM_{act}$, the $FP_{act}$, and a limit PLM equation $$(PLM_i) = \left(\left(\frac{LTM_i}{LTM_{act}}\right) * PLM_{act} - LTM_i\right) * \left(\frac{FP_{\lim}}{FP_{act}}\right) + LTM_i.$$

The i represents a current operating position. The purge learn module sets the $FP_{act}$ equal to the $FP_{lim}$, and the learn module decreases the $FP_{act}$ by a predetermined $FP_{act}$ constant (Y) when the $FP_{des}$ exceeds the $FP_{act}$ and the $PLM_{lim}$ exceeds the $PLM_{act}$, and the purge learn module increases the $FP_{act}$ by the Y when the $FP_{des}$ exceeds the $FP_{act}$ and the $PLM_{act}$ exceeds the $PLM_{lim}$.

In other features, the purge learn module sets the $FP_{act}$ equal to the $FP_{des}$ when the $FP_{act}$ exceeds the $FP_{des}$, and wherein the purge learn module calculates at least one second array value ($PLM_i$) based the $LTM_i$, $LTM_{act}$, $PLM_{act}$, a current position FP ($FP_i$), the $FP_{act}$, the $LTM_i$, and second array equation $$(PLM_i) = \left(\left(\frac{LTM_i}{LTM_{act}}\right) * PLM_{act} - LTM_i\right) * \left(\frac{FP_i}{FP_{act}}\right) + LTM_i.$$

In other features, the system further comprises a threshold compensation module that determines a second array value ($PLM_i$) when the amount of sad fuel vapor falls below a fuel vapor threshold. The second array is a multiplier to a fuel rate. The i represents a current position. The threshold compensation module determines a threshold flow percentage ($FPDC_{thres}$) when a duty cycle (DC) of a valve in the fuel system exceeds a DC threshold, wherein the $FPDC_{thres}$ is based on a gas constant ($C_1$), a pressure driving function (δ), a corrected pressure ($P_{corr}$), an ambient temperature ($T_{amb}$), an engine airflow ($m_{engair}$), and a $FP^{thres}$ equation $$(FP_{100DC}) = \frac{\left(\frac{C_1 * \delta * P_1}{T_{amb}^{1/2}}\right)}{M_{eng}}.$$

The δ is calculated based on the $P_{corr}$, a manifold absolute pressure ($P_2$), an air constant ($C_1$), and the δ equation $\delta = 3.8639(PR^{1.42857} - PR^{1.71428})^{0.5}$. The $P_{corr}$ is based on a barometric pressure ($P_{baro}$), a DC threshold, the DC, a second slope ($M_2$), a second offset ($B_2$), and a first pressure ($P_1$).

In other features, the threshold compensation module determines a DC threshold second array value ($PLM_{thres}$) based on the $FP_{act}$, an active first array value ($LTM_{act}$), the ($FP_{thres}$), the $FP_{act}$, and a $PLM_{thres}$ equation $$(PLM_{100DC}) = (PLM_{act} - LTM_{act}) * \left(\frac{FP_{100DC}}{FP_{act}}\right) + LTM_{act}.$$

The threshold compensation module determines at least one first array value ($LTM_i$) based on the $PLM_i$, an active second array value ($PLM_{act}$), an active first array value ($LTM_{act}$), a flow percentage ($FP_i$), the $FP_{act}$, and a $LTM_i$ equation $$(LTM_i) = \frac{PLM_i}{\left(\left(\frac{PLM_{act}}{LTM_{act}}\right) - 1\right) * \left(\frac{FP_i}{FP_{act}}\right) + 1}$$

when the engine is turned off.

In other features, the purge initialization module determines the amount of the fuel vapor when an off time of the engine exceeds an off time threshold.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
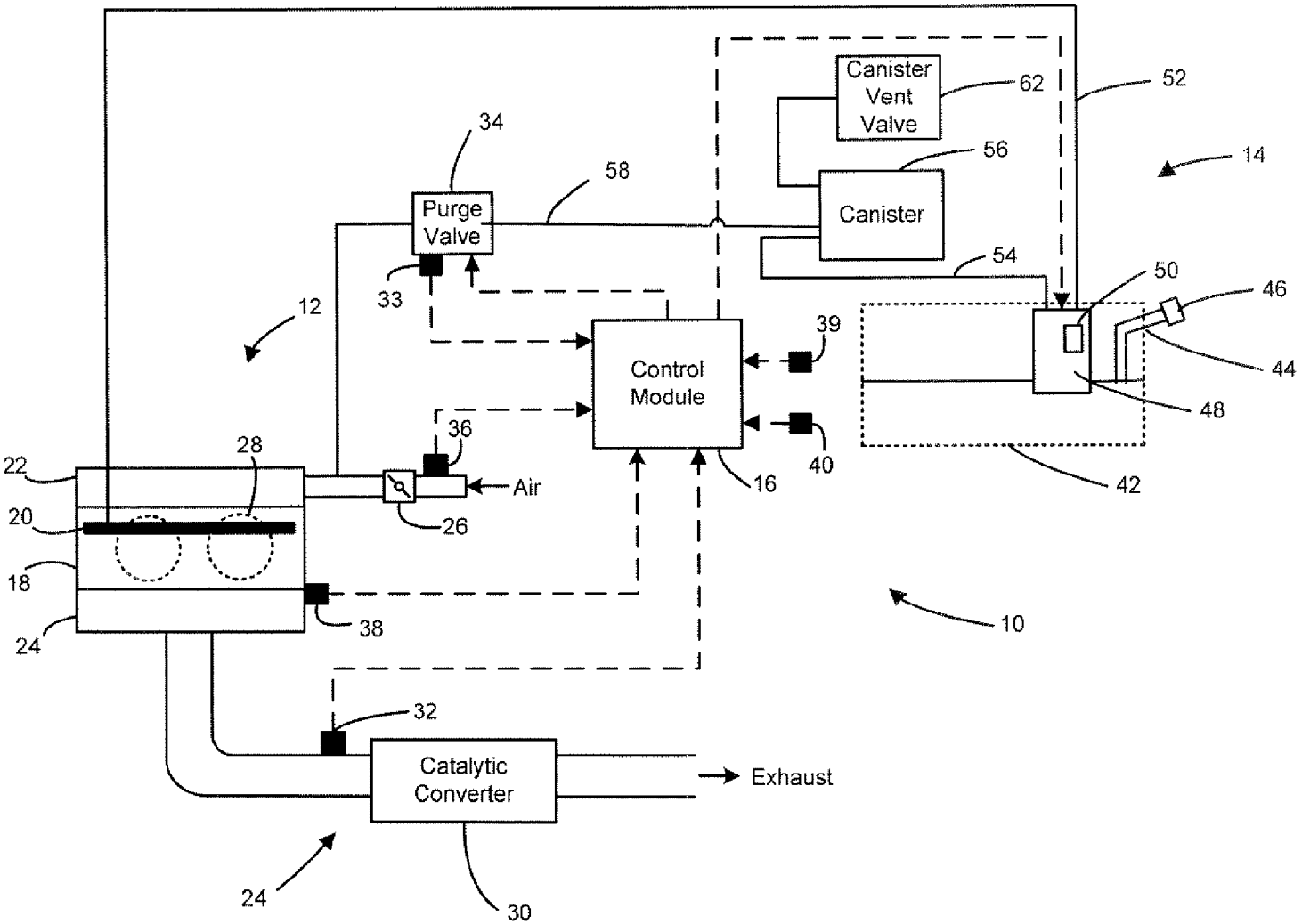
FIG. 1 is a functional block diagram of an engine control system and a fuel system according to the present invention.

The following description of the preferred embodiment is merely exemplary in nature and is in no way intended to limit the invention, its application, or uses. For purposes of clarity, the same reference numbers will be used in the drawings to identify similar elements. As used herein, the term module refers to an application specific integrated circuit (ASIC), an electronic circuit, a processor (shared, dedicated, or group)

and memory that execute one or more software or firmware programs, a combinational logic circuit, and/or other suitable components that provide the described functionality.

Referring to FIG. 1, a vehicle 10 includes an engine system 12 and a fuel system 14. One or more control modules 16 communicate with the engine and fuel systems 12, 14. The fuel system 14 selectively supplies liquid and/or fuel vapor to the engine system 12, as will be described in further detail below.

The engine system 12 includes an engine 18, a fuel injection system 20, an intake manifold 22, and an exhaust manifold 24. Air is drawn into the intake manifold 22 through a throttle 26. The throttle 26 regulates mass air flow into the intake manifold 22. Air within the intake manifold 22 is distributed into cylinders 28. The air is mixed with fuel and the air/fuel (A/F) mixture is combusted within cylinders 28 of the engine 18. Although two cylinders 28 are illustrated, it can be appreciated that the engine 18 can include any number of cylinders 28 including, but not limited to 1, 3, 4, 5, 6, 8, and 12 cylinders. The fuel injection system 20 includes liquid injectors that inject liquid fuel into the cylinders 28.

Exhaust flows through the exhaust manifold 24 and is treated in a catalytic converter 30. An exhaust oxygen sensor 32 (e.g., a wide-range A/F ratio sensor) communicates exhaust A/F ratio signals to the control module 16. A voltage (V) sensor 33 communicates an operating V supplied to a purge valve 34 to the control module 16. A mass engine air flow ($M_{engair}$) sensor 36 is located within an air inlet and communicates a $M_{engair}$ signal based on the mass of air flowing into the engine system 12 to the control module 16. An intake manifold absolute pressure ($P_2$) sensor 38 senses the pressure within the intake manifold 22 of the engine and communicates a $P_2$ signal to the control module 16. Ambient temperature ($T_{amb}$) and barometric pressure ($P_{baro}$) signals are generated by $T_{amb}$ and $P_{baro}$ sensors 39, 40, respectively.

The control module 16 controls the fuel and air provided to the engine based on oxygen sensor signals and throttle valve position. This form of fuel control is also referred to as closed loop fuel control. Closed loop fuel control is used to maintain the A/F mixture at or close to an ideal stoichiometric A/F ratio by commanding a desired fuel delivery to match the airflow. Stoichiometry is defined as an ideal A/F ratio (e.g., 14.7 to 1 for gasoline). The engine control may command different airflow to compensate the engine speed changes during engine idle operation.

The engine system 12 operates in a lean condition (i.e., reduced fuel) when the A/F ratio is higher than the stoichiometric A/F ratio. The engine system 12 operates in a rich condition when the A/F ratio is below the stoichiometric A/F ratio. A fuel control factor helps determine whether the A/F ratio is within an ideal range (i.e., above a minimum value and below a maximum value). An exemplary fuel control factor includes a short term integrator (STI) that provides a rapid indication of fuel enrichment based on input from the oxygen sensor signals. For example, if the signals indicate an A/F ratio greater than a specified reference, the STI is increased a step. Conversely, if the signals indicate an A/F ratio less than the specified reference, the STI is decreased a step. A fuel control modifier monitors changes in the fuel control factor over a long term. An exemplary fuel control modifier includes a long term modifier (LTM). The LTM monitors STI and uses integration to produce its output.

The fuel system 14 includes a fuel tank 42 that contains liquid fuel and fuel vapor. A fuel inlet 44 extends from the fuel tank 42 to enable fuel filling. A fuel cap 46 closes the fuel inlet 44 and may include a bleed hole (not shown). A modular reservoir assembly (MRA) 48 is disposed within the fuel tank 42 and includes a fuel pump 50. The MRA 48 includes a liquid fuel line 52 and a fuel vapor line 54.

The fuel pump 50 pumps liquid fuel through the liquid fuel line 52 to the fuel injection system 20 of the engine 18. A fuel vapor system includes the fuel vapor line 54 and a canister 56. Fuel vapor flows through the fuel vapor line 54 into the canister 56. A fuel vapor line 58 connects the purge valve 34 to the canister 56. The control module 16 modulates the purge valve 34 to selectively enable fuel vapor to flow into the intake system of the engine 18. The control module 16 modulates a canister vent valve 60 to selectively enable air flow from atmosphere into the canister 56.

Figure 2:
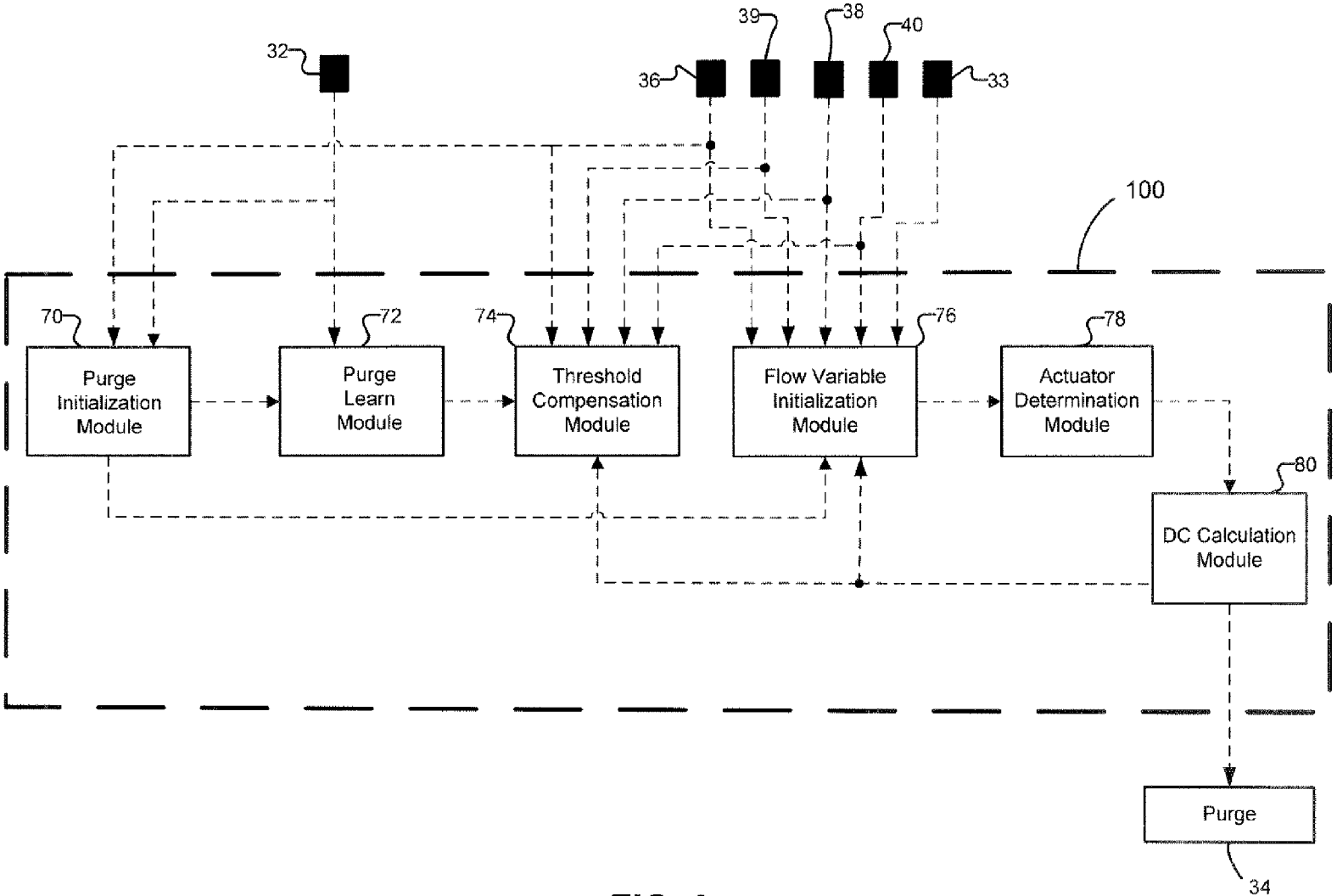
FIG. 2 is a functional block diagram of an engine control module (ECM) according to the present invention.

Referring now to FIG. 2, an engine control system 100 will be described in further detail. The engine control system 100 includes communicating with the exhaust oxygen sensor 32, the $M_{engair}$ sensor 36, the $T_{amb}$ sensor 39, the $P_2$ sensor 38, the $P_{baro}$ sensor 40, and the V sensor 33. A purge initialization module 70 receives signals from the exhaust oxygen sensor 32 and the $M_{engair}$ sensor 36. The purge initialization module 70 captures initialization variables and determines initial purge control conditions by determining the amount of fuel vapors present within the fuel system 14.

A purge learn module 72 communicates with the initialization module 70 and receives signals from the exhaust oxygen sensor 32. The purge learn module 72 determines an array of purge learn memory (PLM) values for a current engine operating condition and adaptively learns the PLM values for the remaining engine operating conditions. The PLM values correct for errors in the fuel system 14 when the purge valve 34.

A threshold compensation module 74 receives signals from the $M_{engair}$ sensor 36, the $T_{amb}$ sensor 39, the $P_2$ sensor 38, and the $P_{baro}$ sensor 40. The threshold compensation module 74 communicates with the purge learn module 72 and the duty cycle (DC) calculation module 80 and calculates PLM values when the DC of the purge valve 34 has exceeded a DC threshold. The threshold compensation module 74 stores the PLM values in a long term memory (LTM) array (not shown) when engine 18 is off.

A flow variable initialization module 76 receives signals from the $M_{engair}$ sensor 36, the $T_{amb}$ sensor 39, the $P_2$ sensor 38, the $P_{baro}$ sensor 40, and the V sensor 33. The flow variable initialization module 76 communicates with the purge initialization module 70 and the DC calculation module 80. The flow variable initialization module 76 determines the initial flow variables utilized to control the operation of the purge valve 34.

An actuator determination module 78 communicates with the flow variable initialization module 76. The actuator determination module 78 determines the characteristics of an actuator (not shown) of the purge valve 34 based on parameters received from the flow variable initialization module 76.

The DC calculation module 80 communicates with the actuator determination module 78 and the threshold compensation module 74. The DC calculation module 80 determines the DC of the purge valve 34 for DC operation below the DC threshold and for DC operation that exceeds the DC threshold. The DC calculation module 80 commands the actuator of the purge valve 34.

The engine control system 100 controls the purge valve 34 based on adjustments made to the DC of the purge valve 34 for distinct actuator characteristics of the purge valve 34 during various engine operating conditions. The engine control system 100 controls the introduction of purge flow into of the engine 18 based on the adjusted DC, thereby providing an accurate control of A/F mixture supplied to the engine 18.

Figure 3:
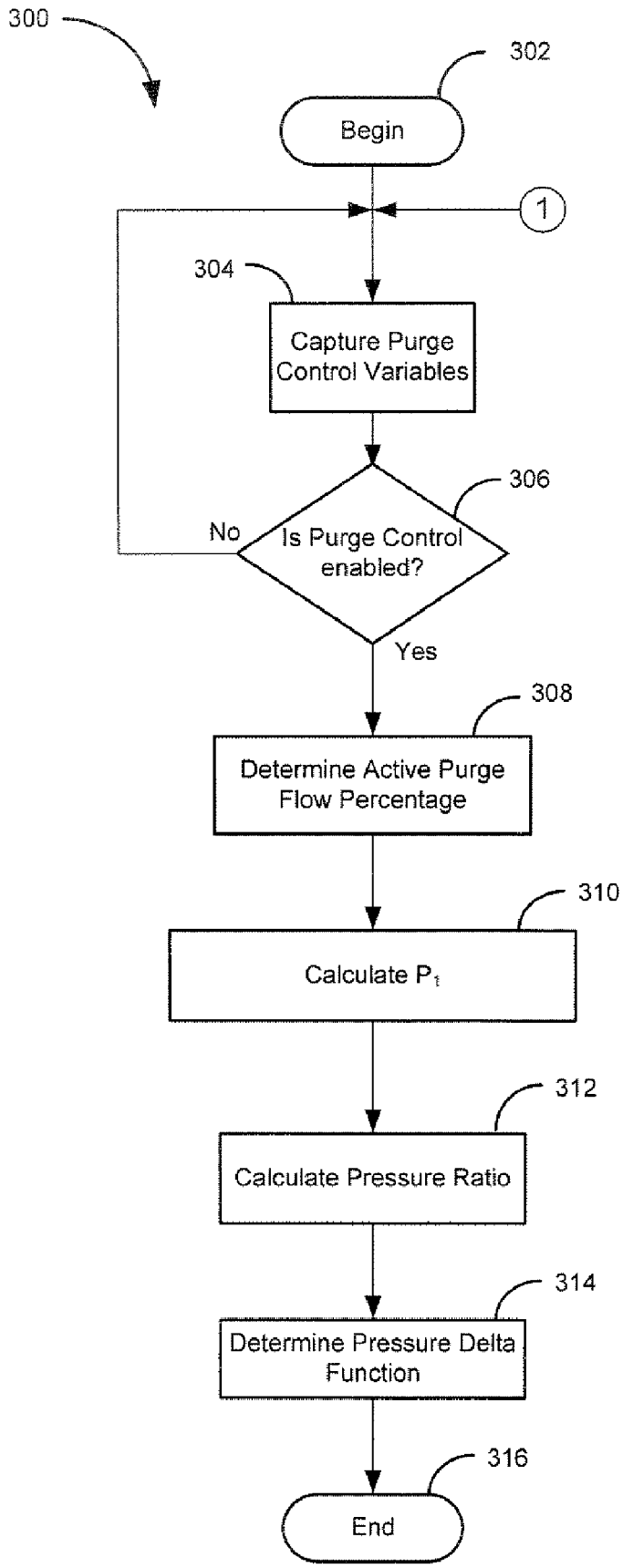
FIG. 3 is a flow diagram illustrating steps of a method for determining flow variables according to the present invention.

Referring now to FIG. 3, a method 300 for determining the flow variables in the engine control system 100 will be described in more detail. In the present implementation, an exemplary embodiment of the purge valve 34 will relate to the characteristics and operation of a 95 liters per minute (LPM) purge valve. Those skilled in the art can appreciate that various other embodiments of the purge valve 34 are contemplated within the scope of this invention including, but not limited to, a 71 LPM purge valve. The method 300 begins in step 302. In step 304, control initializes the purge control variables by processing signals provided by the $M_{engair}$ sensor 36, the $P_{baro}$ sensor 40, the $P_2$ sensor 38, the $T_{amb}$ sensor 39, and the V sensor 33. Control also initializes $DC_{second}$. Control determines whether the purge control is enabled in step 306. If control determines that the purge control is not enabled, control returns to step 304. If control determines that the purge control is enabled, control proceeds to step 308. In step 308, control determines an active purge flow percentage ($FP_{act}$). Control can determine the $FP_{act}$ from sources including, but not limited to, a $FP_{act}$ look-up table (not shown) and a predetermined purge closed loop equation (not shown). The $FP_{act}$ look-up table is a function of $M_{engair}$. In an exemplary embodiment, $FP_{act}$ can be approximately 3%, although it should be appreciated that other values of $FP_{act}$ are anticipated.

In step 310, control calculates a first pressure ($P_1$) representing the pressure upstream from the inlet of the purge valve 34. Generally, the pressure experienced by the fuel system 14, $P_{baro}$, is subject to a drop in pressure as air flows through the purge line 58 resulting in $P_1$. $P_1$ represents a calculated pressure at the inlet of the purge valve 34. The value of $P_1$ is determined according the following equation:

$$P_1 = P_{baro} - K * \left(FP_{act} * M_{engair} * \frac{T_{amb}}{P_{baro}}\right)^2 \quad (1)$$

where K represents a calibrated constant (e.g. 0.173). Although K may be 0.173 in the current example, other values for K are anticipated. In step 312, control calculates the pressure ratio (PR) of a second pressure ($P_2$) relative to $P_1$. $P_2$ represents the pressure downstream from the purge valve 34 and is supplied by the $P_2$ sensor 38. In the current invention, $P_2$ acts as a negative pressure upon the purge valve 34. Once control has determined PR, control next determines the pressure delta function (δ) in 314. δ represents a compressible gas characterization. In an exemplary embodiment, δ can range from 0 to 1. Control can determine δ from sources including, but not limited to, a δ look-up table (not shown) based on PR and/or a δ equation. δ can be calculated according to the following equation:

$$\delta=1, \text{ for } PR<PR_{thres} \quad (2)$$

$$\delta=3.8639(PR^{1.42857}-PR^{1.71428})^{0.5} \text{ for } PR>PR_{thres} \quad (3)$$

Where $PR_{thres}$ represents a pressure ratio threshold and $A_1$ represents an air constant. In an exemplary embodiment, δ is based on a $PR_{thres}$ Of approximately 0.528. In step 316, the method 300 ends.

Figure 4:
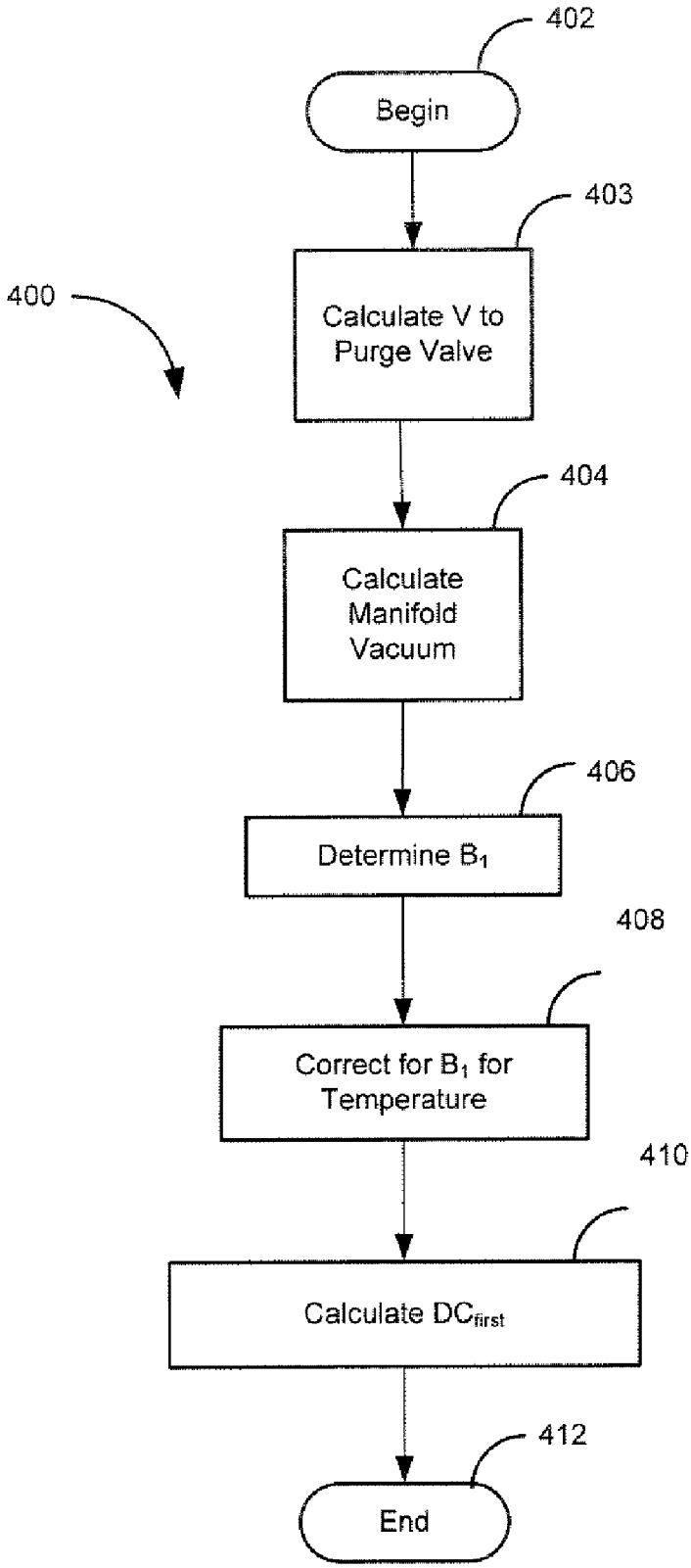
FIG. 4 is a flow diagram illustrating steps of a method for determining the actuator variables according to the present invention.

Referring now to FIG. 4, a method 400 of determining actuator characteristics is discussed in more detail. Control begins the method 400 in step 402. In step 403, control calculates a voltage level supplied to the purge valve 34. In step 404, control calculates a manifold vacuum (MV) value. MV is used by control to correct for characteristics of distinct actuators of the purge valve 34. ($P_1$-$P_2$) represents a force upon the purge valve 34 that can be approximated by MV. The force results from the difference between $P_{baro}$ delivered to the fuel system 14 and $P_2$ acting downstream of the purge valve 34. In various embodiments, the purge valve 34 can be pressure compensated, therefore eliminating the need to take into account MV.

In step 406, control determines a first base purge valve offset ($B_1$). Control can determine $B_1$ for various operating conditions from sources including, but not limited to, a $B_1$ look-up table (not shown). In various embodiments, the look-up table may be a function of, but is not limited to, MV and/or operating V. Generally, operation of the purge valve 34 is primarily affected by V and MV. Typically, the absolute temperature of the fuel vapor that is estimated by the intake manifold temperature, $T_{inlet}$, affects $B_1$ to a lesser degree. For the sake of simplicity, $T_{inlet}$ can be assumed to be $T_{amb}$. In an exemplary embodiment, the purge valve 34 operates at approximately 12V and approximately 20 degrees Celsius. $B_1$ serves as a first offset to a first linear curve, detailed below, which calculates the valve effective area ($A_{eff}$) of the purge valve 34.

In step 408, control corrects $B_1$ for changes in temperature as $T_{amb}$ of the purge valve 34 varies from 20 degrees Celsius. In step 410, control calculates a first purge valve duty cycle ($DC_{first}$) for purge valve 34 under operating conditions in which DC does not deviate from linearity (e.g., approximately 98%). The DC of the purge valve 34 is the ratio of the "on time," or time the purge valve 34 is open relative to the time of a single cycle of operation. Generally, DC is expressed as a percentage value. The DC of the purge valve 34 is calculated as follows:

$$M_{purge}=FP*M_{engair} \quad (4)$$

$$M_{purge} = C_1 * A_{eff} * \delta * \frac{P_1}{T_{amb}^{1/2}} \quad (5)$$

In equations (4) and (5), $A_{eff}$ represents the effective flow area across the purge valve 34. The value of $A_{eff}$ is calculated for each distinct actuator of the purge valve 34 that may be used in the fuel system 14. $A_{eff}$ is a normalized, dimensionless value which ranges from 0 to 1. $A_{eff}$ can be characterized by two linear curves that are based on the operation of the purge valve 34, specifically the duty cycle (DC) of the purge valve 34.

$M_{purge}$ represents the purge mass air flow of the fuel system 14. $C_1$ is a constant that considers factors including, but not limited to, the area of the purge valve 34, discharge coefficients of the purge system, and/or thermodynamics characteristics associated with the purge gas. Each purge valve 34 corresponds to a distinct value of $C_1$. Therefore, if the purge valve 34 implemented in the fuel system 14 is changed, the value of $C_1$ will also be modified. In the present implementation, $C_1$ can have a value of 5.68. In various embodiments in which a 71 LPM purge valve 34 is contemplated, $C_1$ can be 4.12. Combining equations (4) and (5) and isolating $A_{eff}$ leads to:

$$A_{eff} = FP * \frac{M_{engair}}{C_1 * \delta * P_1 * \left(\frac{1}{T_{amb}}\right)^{\frac{1}{2}}} \quad (6)$$

Where $M_1$ represents a slope characterizing the purge valve 34 while operating below a predetermined DC threshold, which is discussed in further detail below. Generally, $M_1$ is independent of operating conditions of the purge valve 34 that contribute to the variance of $B_1$. In various embodiments of the current invention, the frequency of operation of the purge valve 34 includes, but is not limited to, 8 Hz, 16 Hz, and/or 32 Hz.

$$A_{eff}=M_1*DC_{first}+B_1 \tag{7}$$

Combining equations (6) and (7) and isolating DC leads to:

$$DC_{first}=\left(\frac{FP}{M_1}\right)*\frac{M_{engair}}{\left(C_1*\delta*\frac{P_1}{(T_{amb})^{\frac{1}{2}}}\right)}-\frac{B_1}{M_1} \tag{8}$$

In step 412, the method 400 ends.

Figure 5:
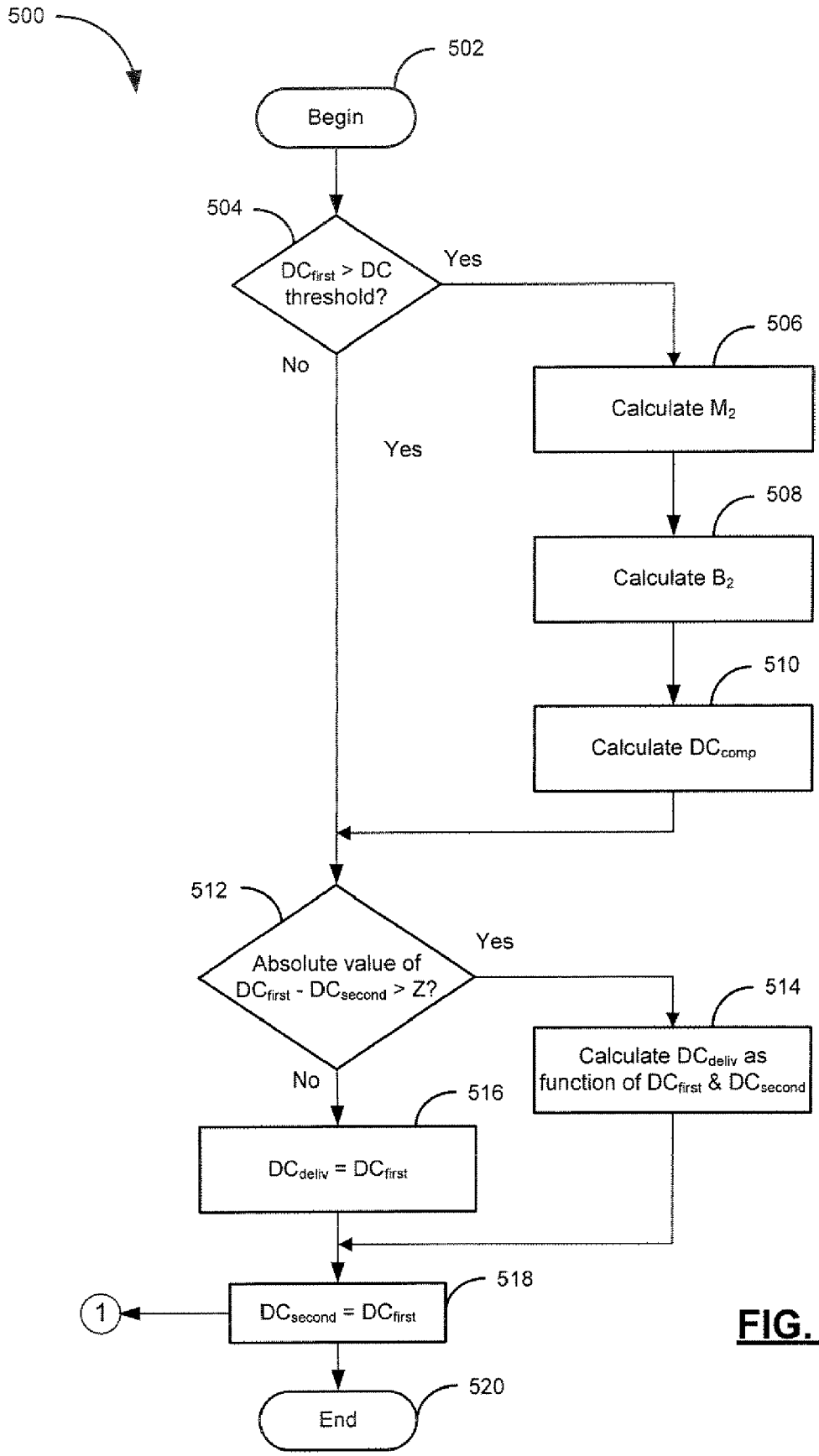
FIG. 5 is a flow diagram illustrating steps of a method for determining transient duty cycle (DC) compensation according to the present invention.

Referring now to FIG. 5, a method 500 for determining transient DC compensation will be discussed in more detail. Control begins the method 500 in step 502. In step 504, control determines whether the $DC_{first}$ calculated in step 410 of method 400 exceeds the DC threshold. In various embodiments including, but not limited to, the 95 LPM and 71 LPM purge valves 60, the DC threshold may be 98%. If $DC_{first}$ exceeds the DC threshold, control proceeds to step 506. In step 506, control calculates a compensated purge valve 34 slope, $M_2$, of a second linear curve that characterizes the purge valve 34 when $DC_{first}$ exceeds the DC threshold.

Next, control calculates a compensated offset $B_2$ for the second linear curve in step 508. $M_2$ and $B_2$ are determined as functions of $M_1$ and $B_1$, respectively. The following equation represents the second linear curve:

$$A_{comp\ eff}=M_2*DC_{comp}+B_2 \tag{9}$$

In step 510, $DC_{comp}$ is calculated in similar fashion to $DC_{first}$ according to:

$$DC_{comp}-\left(\frac{FP}{M_2}\right)*\frac{M_{engair}}{\left(C_1*\delta*\frac{P_1}{(T_{amb})^{\frac{1}{2}}}\right)}-\frac{B_2}{M_2} \tag{10}$$

Upon calculating $DC_{comp}$, $DC_{first}$ is set equal to $DC_{comp}$ and control proceeds to step 512. If $DC_{first}$ did not exceed the DC threshold in step 504, control proceeds to step 512. In step 512, control determines the absolute value of the difference between $DC_{first}$ and $DC_{second}$. If the difference exceeds a predetermined constant, Z, control proceeds to step 514. In step 514, control determines a delivered DC ($DC_{deliv}$) as a function of $DC_{first}$ and $DC_{second}$. The $DC_{deliv}$ represents the output DC signal commanding the operation of the purge valve 34. If the difference between $DC_{first}$ and $DC_{second}$ does not exceed the predetermined constant Z in step 512, control proceeds to step 516. In step 516, control sets the $DC_{deliv}$ to $DC_{first}$. In step 518, control sets $DC_{second}$ equal to $DC_{first}$ and transmits $DC_{second}$ to 304 of method 300. In step 520, method 500 ends.

Figure 6A:
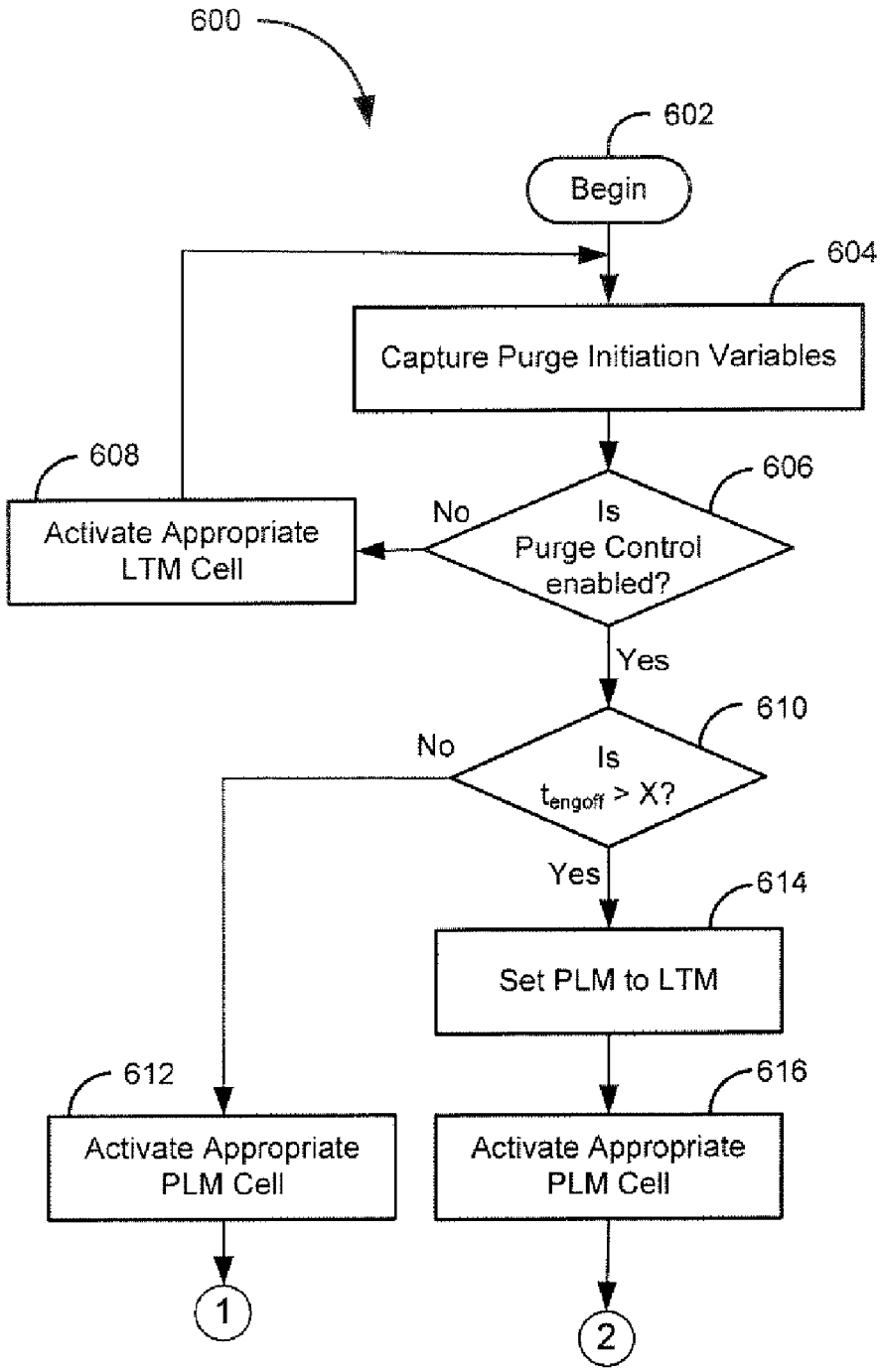
FIG. 6 is a flow diagram illustrating steps of a method for initializing purge control according to the present invention.
Figure 6B:
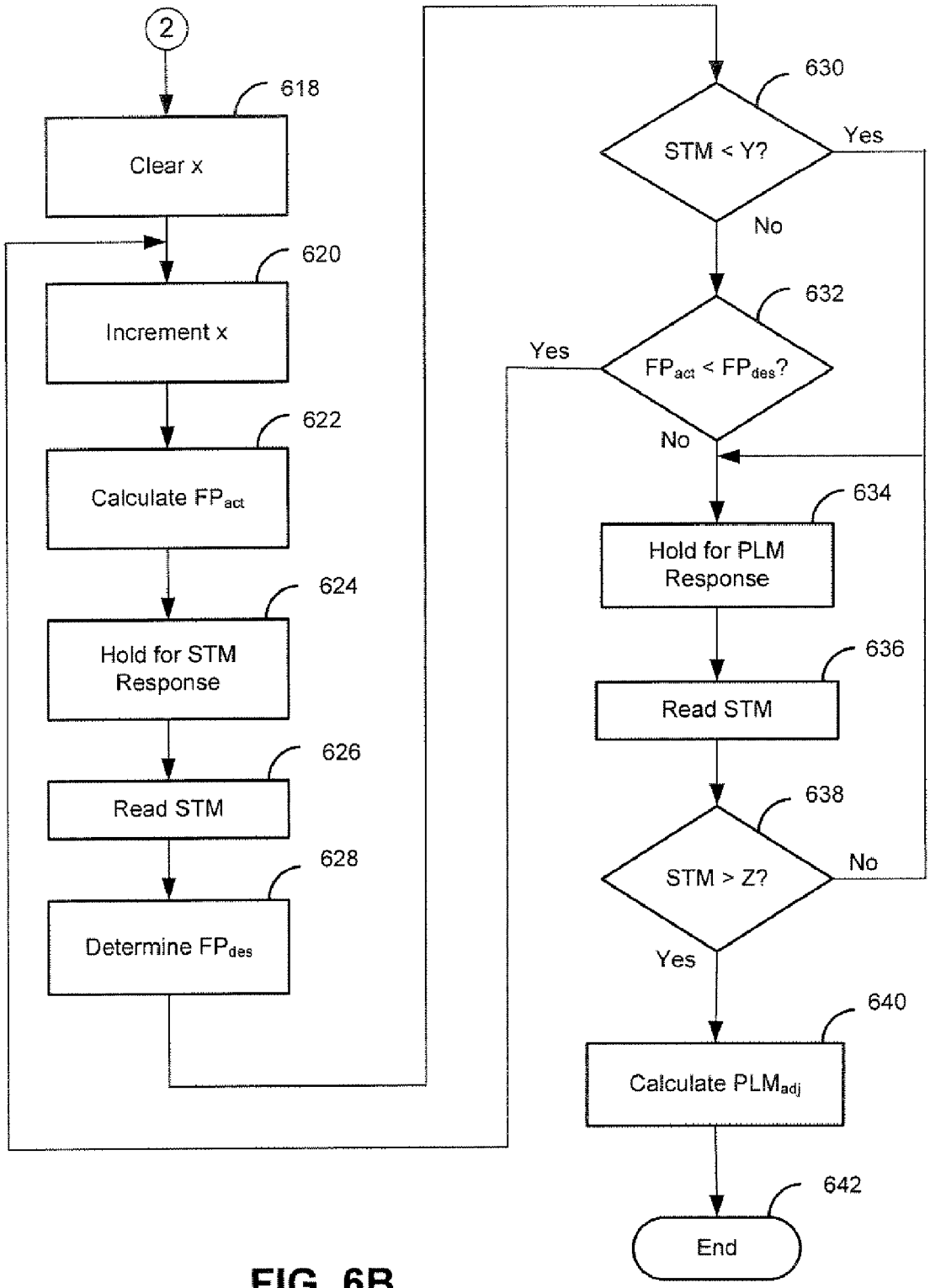

Now referring to FIGS. 6A and 6B, a method 600, for initializing purge control is discussed in more detail. Control begins the method 600 in step 602 when the engine is turned on. In step 604, control captures the purge initialization variables including the engine off time ($t_{engoff}$), engine airflow ($M_{engair}$), LTM values, and PLM values. In an exemplary embodiment, the LTM and PLM can include, but are not limited to, 8 cells. LTM cells are used to determine the long-term closed loop fuel multiplier which controls the fuel injectors of the fuel injection system 20 when the purge valve 34 is off. PLM values are utilized to control the fuel injectors when the purge valve 34 is on. The value of $t_{engoff}$ represents the lapse of time between the previous the previous key down of the engine 12 and the current key up of the engine 12 that occurred in step 602.

In step 606, control determines whether the purge valve 34 control is enabled. If the purge valve 34 control is not enabled, control proceeds to step 608. In step 608, control activates the LTM cell ($LTM_n$) corresponding to the $M_{engair}$ measurement provided by the $M_{engair}$ sensor 36. The LTM, PLM, and FP are indexed by $M_{engair}$. In an exemplary embodiment, the LTM, PLM, and FP indexing is calibrated identically. Control returns to step 604. If the purge valve 34 control is not enabled, control proceeds to 610. In 610, control determines whether $t_{engoff}$ exceeds a predetermined $t_{engoff}$ threshold. $t_{engoff}$ can be, but is not limited to, a time interval equaling approximately 1 hour. If $t_{engoff}$ does not exceed the predetermined $t_{engoff}$ threshold, then control activates the appropriate cell of the PLM based on the $M_{engair}$ value in step 612. In step 612, control uses values of the PLM that were obtained during a previous key cycle. Control then advances to step 740 of method 700.

If $t_{engoff}$ exceeds the predetermined $t_{engoff}$ threshold in step 610, the control proceeds to step 614. In step 614, control sets the cells of the PLM ($PLM_n$) equal to the corresponding cells of the LTM (e.g., $PLM_1=LTM_1$). In step 616, control activates the PLM cell ($PLM_{act}$) based on the $M_{engair}$ value supplied by the $M_{engair}$ sensor 36. In various embodiments, control can reference a look-up table indexed as a function of $M_{engair}$.

In step 618, control clears a purge flow value (x) to avoid substantial "rich" or "lean" A/F mixture excursions. An A/F ratio below 14.7 is referred to as a rich mixture while an A/F ratio above 14.7 is called a lean mixture. An A/F mixture of 14.7 corresponds to the stoichiometric or chemically correct mixture of gasoline. In step 620, control increments the purge flow value and then proceeds to calculate actual purge flow percentage ($FP_{act}$) in step 622. In various embodiments, the $FP_{act}$ can be computed according to the following equation:

$$FP_{act}=0.1*x^2 \tag{11}$$

The previous equation progressively increments $FP_{act}$ in order to effectuate a gradual increase in the level of evaporated gas supplied through the purge valve 34. In step 624, control initiates a hold of the method 600 to allow for an accurate reading to be taken of the closed loop integrator (STM) in step 626. The STM is a multiplier on the fuel rate that determines a switch of fuel system 14 operating conditions from a rich A/F ratio to a lean A/F ratio and vice versa based on the oxygen sensor 32. The oxygen sensor 32 is generally disposed across the exhaust manifold 24 of engine 12. During rich operation of the fuel system 14, the oxygen sensor 32 transmits a first oxygen sensor voltage level to control. At lean operation, the oxygen sensor 32 signals a second oxygen sensor voltage.

In step 628, control determines the desired purge flow percentage ($FP_{des}$) based on $M_{engair}$. In step 630, control determines whether the STM value exceeds a predetermined first STM threshold (Y). If the STM value does not exceed Y, the control proceeds to step 634. If the STM value does exceed Y, then control determines whether $FP_{des}$ exceeds $FP_{act}$ in step 632. If $FP_{des}$ exceeds $FP_{act}$, control returns to step 620. However, if $FP_{des}$ does not exceed $FP_{act}$, control initiates a second hold of the method 600 to obtain a PLM response in step 634 after adaptively learning the STM correction into the PLM. In step 636, control performs a second reading of the STM.

Control determines whether the second reading of the STM exceeds a second STM threshold (Z) in step 638. If the second reading of the STM does not exceed Z, control returns to step 634. If the second reading of the STM exceeds Z in step 640, control calculates an adjusted PLM flow percentage ($PLM_{adj}$) for current active cell of the PLM according to:

$$(PLM_{adj}) = (PLM_{act} - LTM_{act}) * \left(\frac{FP_{des}}{FP_{act}}\right) + LTM_{act} \tag{12}$$

where $LTM_{act}$ represents the value stored in the LTM corresponding to the current active cell. In step 642, the method 600 ends.

Figure 7:
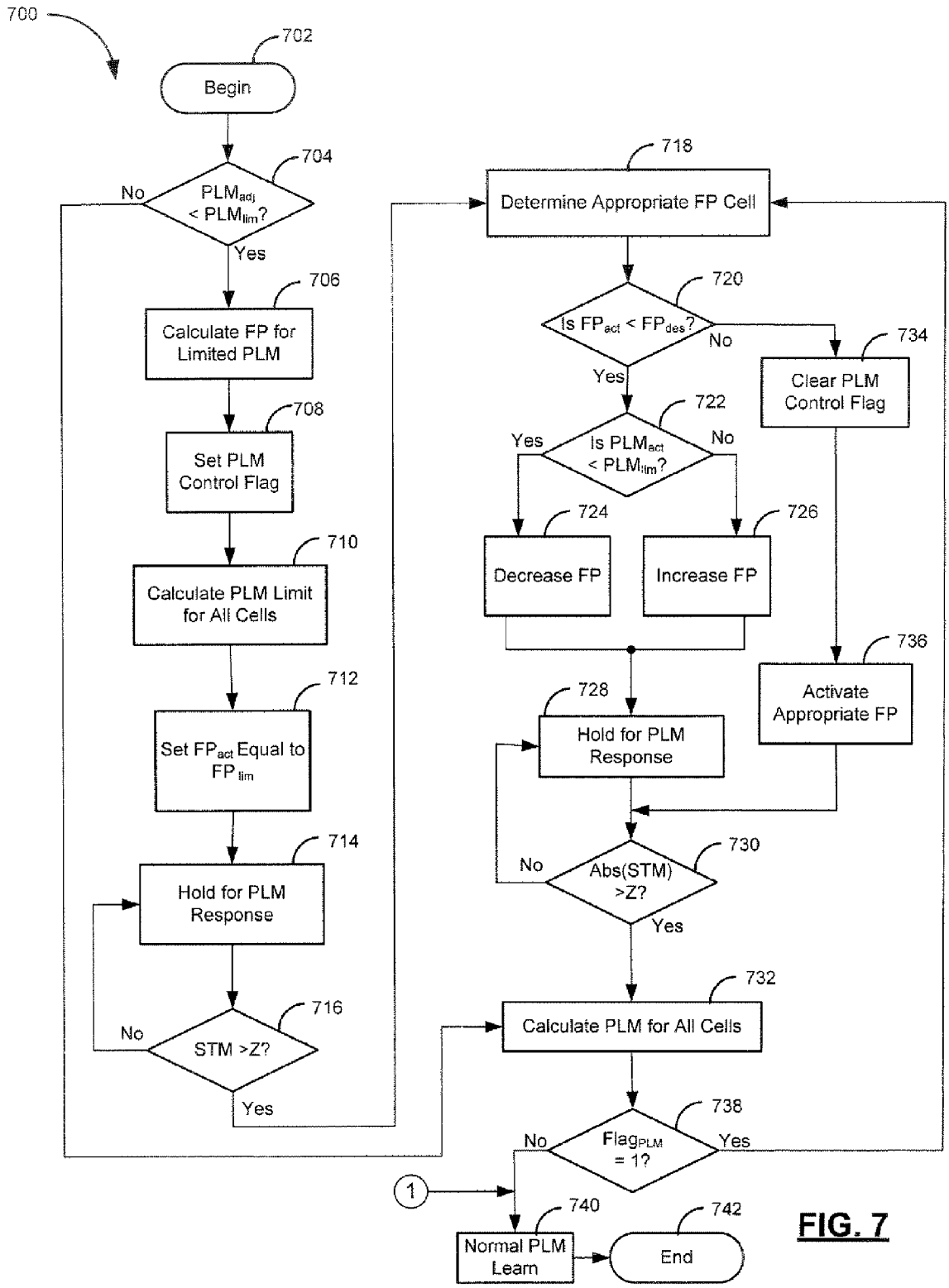
FIG. 7 is a flow diagram illustrating a method for initializing purge control according to the present invention.

Referring now to FIG. 7, a method 700 for vapor control of the PLM is discussed in more detail. Control begins the method 700 in step 702. Next, in step 704, control determines whether $PLM_{adj}$ is below a PLM flow percentage limit ($PLM_{lim}$). If the $PLM_{adj}$ is below the $PLM_{lim}$, control proceeds to step 706. In step 706 control calculates a limited PLM flow percentage ($FP_{lim}$) according to:

$$(FP_{\lim}) = \frac{(PLM_{\lim} - LTM_{act})}{(PLM_{act} - LTM_{act})} * FP_{act} \tag{13}$$

In step 708, control sets a PLM control flag ($flag_{PLM}$) and proceeds in step 710 to calculate the $PLM_{lim}$ value for each cell of the PLM according to:

$$(PLM_i) = \left(\left(\frac{LTM_i}{LTM_{act}}\right) * PLM_{act} - LTM_i\right) * \left(\frac{FP_{\lim}}{FP_{act}}\right) + LTM_i \tag{14}$$

where i corresponds to the current cell position reference. In step 712, control sets the $FP_{act}$ equal to the $FP_{lim}$.

In step 714, control initiates a hold of the method 700 to obtain a PLM response. In step 716, control determines whether the STM value exceeds Z. If the STM value does not exceed Z, control returns to step 714. If the STM value exceeds Z, control determines the appropriate FP cell based on the $M_{engair}$ in step 718. In step 720, control proceeds to determine whether $FP_{act}$ is below $FP_{des}$. If $FP_{act}$ is below $FP_{des}$, control proceeds to step 722. In step 722, control determines whether $PLM_{act}$ is below $PLM_{lim}$. If $PLM_{act}$ is below $PLM_{lim}$, control proceeds to step 724. In step 724, control decreases $FP_{act}$ by a factor of Y. If $PLM_{act}$ exceeds $PLM_{lim}$, control proceeds to step 726. In step 726, control increases $FP_{act}$ by a factor of Y. In step 728, control signals a second hold of the method 700 to obtain a PLM response and the proceeds to step 730.

Referring back to step 720, if the $FP_{act}$ exceeds the $FP_{des}$, control proceeds to step 734. In step 734, control clears the $flag_{PLM}$ and proceeds to step 736. In step 736, control activates a $FP_{act}$ based on the $FP_{des}$. In step 730, control determines whether the absolute STM value exceeds Z. If the value of the STM does not exceed Z, control returns to step 728. If the value of the STM does exceed Z, control proceeds to step 732.

Referring back to step 704, if the $PLM_{adj}$ exceeds the $PLM_{lim}$, control proceeds to step 732. In step 732, control computes the PLM value for each cell of the PLM according to:

$$(PLM_i) = \left(\left(\frac{LTM_i}{LTM_{act}}\right) * PLM_{act} - LTM_i\right) * \left(\frac{FP_i}{FP_{act}}\right) + LTM_i \tag{15}$$

where i corresponds to the cell position within the PLM. In step 738, control determines whether the $flag_{PLM}$ is set. If the $flag_{PLM}$ is set, control returns to step 718. If the $flag_{PLM}$ is not set, control proceeds to step 740. In step 740, control commands the vapor control based on the $FP_{des}$. The method 700 ends in step 742.

Figure 8:
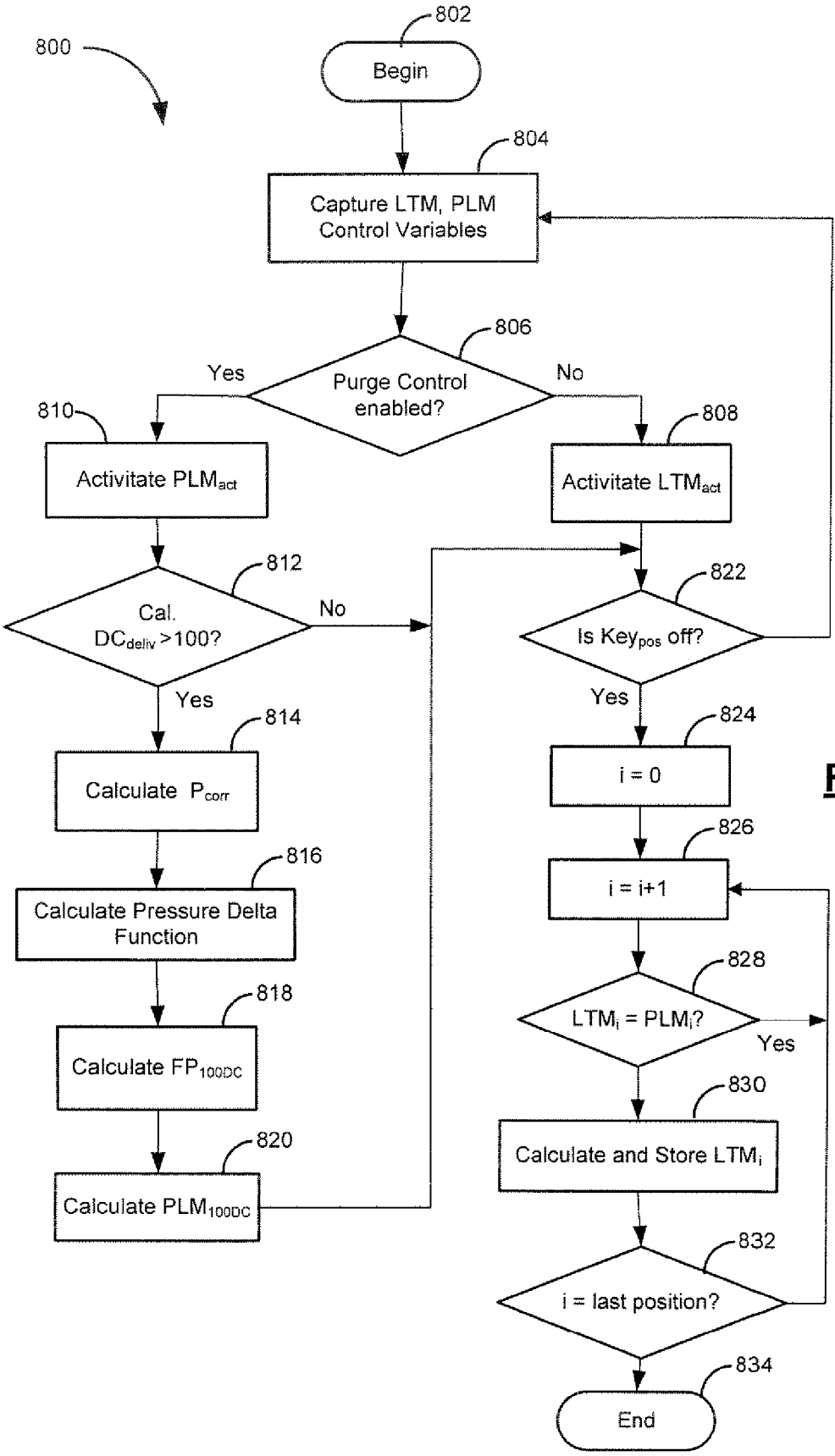
FIG. 8 is a flow diagram illustrating steps of a method for controlling vapor during periods of 100% DC according to the present invention.

Referring now to FIG. 8, a method 800 for vapor control during periods of 100% DC will be discussed in more detail. Control begins the method 800 in step 802. In step 804, control determines the LTM and PLM control variables including, but not limited to, $M_{engair}$, $DC_{new}$, the ignition key position ($key_{pos}$), δ, $P_1$, and $t_{baro}$. In step 806, control determines whether the purge valve 34 control is enabled. If the purge valve 34 control is not enabled, control proceeds to 808. In step 808, control activates the LTM cell ($LTM_{act}$) corresponding to the $M_{engair}$ supplied by the $M_{engair}$ sensor 36 after which, control advances to step 822.

If control determines that the purge valve 34 control is enabled, control proceeds to step 810. In step 810, control activates the PLM cell ($PLM_{act}$) corresponding to the $M_{engair}$. In step 812, control determines whether $DC_{deliv}$ exceeds 100%. If $DC_{deliv}$ is below 100%, then control proceeds to step 822. If $DC_{deliv}$ exceeds 100%, control proceeds to step 814. In step 814, control computes a flow corrected $P_1$ ($P_{corr}$) for the $FP_{act}$ according to:

$$(P_{corr}) = P_{baro} - \frac{(100 * M_2 - B_2)}{(DC_{new} * M_2 - B_2)} * (P_{baro} - P_1) \tag{16}$$

In step 816, control recalculates δ with the $P_{corr}$ supplied by step 814. In step 818, control determines the $FP_{act}$ experienced by the purge valve 34 at 100% DC according to the following equation:

$$(FP_{100DC}) = \frac{\left(\frac{C_1 * \delta * P_1}{T_{amb}^{\frac{1}{2}}}\right)}{M_{eng}} \tag{17}$$

In step 820, control computes the adjusted PLM ($PLM_{100DC}$) while the purge valve 34 is operating at 100% DC according to the following equation:

$$(PLM_{100DC}) = (PLM_{act} - LTM_{act}) * \left(\frac{FP_{100DC}}{FP_{act}}\right) + LTM_{act} \tag{18}$$

In step 822, control determines whether the $key_{pos}$ is in an off state. If control determines that the $key_{pos}$ is not set to off, control returns to step 804. If the $key_{pos}$ is set to off, control proceeds to step 824. In step 824, control initializes the cell position reference, i, to zero. In step 826, control increments the cell position reference. In step 828, control compares the LTM value to the PLM value for each corresponding cell position. If the value of the LTM is equivalent to the PLM for the current cell, control returns to 826. If the value of the LTM is not equivalent to the PLM for the current cell, control proceeds to step in 830. In step 830, control calculates and stores the LTM cell value based on the corresponding PLM cell according to the following equation:

$$(LTM_i) = \frac{PLM_i}{\left(\frac{PLM_{act}}{LTM_{act}} - 1\right) * \left(\frac{FP_i}{FP_{act}}\right) + 1} \quad (19)$$

In step 832, control determines whether i equals the last reference position of the PLM and LTM. If i does not equal the last position of the PLM and LTM, control returns to step 826. If i does equal the last position of the PLM and LTM, control proceeds to step 834. In step 834, control ends.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, the specification and the following claims.

What is claimed is:

1. A control system for controlling a valve in a fuel system of engine, comprising:

an engine airflow sensor that senses a mass engine airflow ($M_{engair}$);

a barometric pressure sensor that senses a barometric pressure ($P_{baro}$);

an ambient temperature sensor that senses an ambient temperature ($T_{amb}$);

an actuator determination module that determines an effective area ($A_{eff}$) of said valve based on at least one of said $M_{engair}$, said $P_{baro}$, and said $T_{amb}$; and a duty cycle (DC) calculation module that determines a first duty cycle (DC) of said valve based on said $A_{eff}$.

2. The system of claim 1 wherein said first DC is based on said $A_{eff}$, a first slope ($M_1$), a first offset ($B_1$), and a first DC equation, $$DC_{first} = \left(\frac{FP}{M_1}\right) * \frac{M_{engair}}{\left(C_1 * \delta * \frac{P_l}{(T_{amb})^{\frac{1}{2}}}\right)} - \frac{B_1}{M_1}.$$

3. The system of claim 2 wherein said $A_{eff}$ is based on said $M_{engair}$, a purge flow percentage (FP) of said valve that is based on said $M_{engair}$, a first predetermined constant ($C_1$), a pressure driving function δ, a first pressure ($P_1$), said $T_{amb}$, and an $A_{eff}$ equation $$A_{eff} = FP * \frac{M_{engair}}{C_1 * \delta * P_1 * \left(\frac{1}{T_{amb}}\right)^{\frac{1}{2}}}.$$

4. The system of claim 3 wherein said $P_1$ is based on said $P_{baro}$, a second predetermined constant ($K_1$), an active purge flow percentage ($FP_{act}$), said $M_{engair}$, said $T_{amb}$, said $P_{baro}$, and a $P_1$ equation $$P_1 = P_{baro} - K * \left(FP_{act} * M_{engair} * \frac{T_{amb}}{P_{baro}}\right)^2.$$

5. The system of claim 2 wherein said DC calculation module computes a compensated DC that is based on said $A_{eff}$, a second slope ($M_2$), a second offset ($B_2$), and a compensated DC equation $$DC_{first} = \left(\frac{FP}{M_1}\right) * \frac{M_{engair}}{\left(C_1 * \delta * \frac{P_1}{(T_{amb})^{\frac{1}{2}}}\right)} - \frac{B_2}{M_2}$$

when said first DC one of exceeds a DC threshold and falls below said DC threshold, said $M_2$ and said $B_2$ are based on said $B_1$, and said first DC is set equal to said compensated DC.

6. The system of claim 2 wherein said $B_1$ is based on at least one of: a manifold vacuum (MV), said V supplied to said valve, and said $T_{amb}$, wherein said MV is based on a MV equation ($P_{baro}$–$P_2$).

7. The system of claim 5 wherein said DC calculation module commands said valve with a first delivered DC when a difference between said first DC and a second DC exceeds a predetermined comparison threshold, wherein said first delivered DC is based on said first DC and said second DC; and said DC calculation module commands said valve with a second delivered DC when said difference between said first DC and said second DC falls below said predetermined comparison threshold, wherein said first delivered DC is set equal to said second delivered DC.

8. The system of claim 7 wherein said second DC is set equal to said first DC.

9. The system of claim 4 wherein said δ is based on a pressure ratio of said $P_1$ to said $P_2$;

wherein said δ is equal to a δ constant when said pressure ratio falls below a δ threshold; and wherein said δ is based on said $P_1$, said $P_2$, and a δ equation $\delta = 3.8639(PR^{1.42857} - PR^{1.71428})^{0.5}$ when said pressure ratio exceeds a δ threshold.

* * * * *